United States Patent [19]

Brown et al.

[11] Patent Number: 4,718,485

[45] Date of Patent: Jan. 12, 1988

[54] PATTERNS HAVING HORIZONTAL AND VERTICAL WELLS

[75] Inventors: Alfred Brown; Marc F. Fontaine; Margaret A. Hight, all of Houston, Tex.

[73] Assignee: Texaco Inc., White Plains, N.Y.

[21] Appl. No.: 914,214

[22] Filed: Oct. 2, 1986

[51] Int. Cl.[4] ..... E21B 43/24; E21B 43/30

[52] U.S. Cl. ..... 166/50; 166/245; 166/263; 166/272

[58] Field of Search ..... 166/50, 245, 268, 263, 166/272

[56] References Cited

U.S. PATENT DOCUMENTS

| | | | |
|---|---|---|---|
| 3,004,596 | 10/1961 | Parker et al. | 166/245 |
| 4,283,088 | 8/1981 | Tabakov et al. | 299/2 |
| 4,390,067 | 6/1983 | Willman | 166/245 |
| 4,522,260 | 6/1985 | Wolcott, Jr. | 166/50 X |

*Primary Examiner*—George A. Suchfield

*Attorney, Agent, or Firm*—Jack H. Park; Kenneth R. Priem; Harold J. Delhommer

[57] ABSTRACT

The invention is a well pattern containing at least one substantially horizontal production well approximately located on and parallel to an axis running between two substantially vertical production wells with the horizontal well having a length equal to about 30% to about 60% of the distance between the two vertical production wells.

10 Claims, 6 Drawing Figures

PATTERNS HAVING HORIZONTAL AND VERTICAL WELLS

BACKGROUND OF THE INVENTION

The invention process is concerned with the enhanced recovery of oil from underground formations. More particularly, the invention relates to the length of horizontal production wells located between vertical production wells in patterns containing horizontal and vertical wells.

Horizontal wells have been investigated and tested for oil recovery for quite some time. Although horizontal wells may in the future be proven economically successful to recover light petroleum from many types of formations, at present, the use of horizontal wells is usually limited to formations containing highly viscous crude. It seems likely that horizontal wells will soon become a chief method of producing tar sand formations and other highly viscous oils which cannot be efficiently produced by conventional methods because of their high viscosity.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

U.S. Pat. No. 4,283,088 illustrates the use of a system of radial horizontal wells, optionally in conjunction with an inverted 9-spot having an unsually large number of injection wells. U.S. Pat. No. 4,390,067 illustrates a scheme of using horizontal and vertical wells together to form a pentagonal shaped pattern which is labeled a "5-spot" in the patent, although the art recognizes a different pattern as constituting a 5-spot.

SUMMARY OF THE INVENTION

The invention is a well pattern which contains at least one substantially horizontal production well approximately located on and parallel to an axis running between two substantially vertical production wells. The horizontal production well must have a length equal to about 30% to about 60% of the distance between the two vertical production wells.

DETAILED DESCRIPTION

Figure 1:
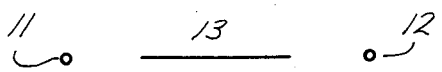
FIG. 1 illustrates the invention, wherein a horizontal production well is located between two vertical production wells in a well pattern, said horizontal well having a length of about 30% to 60% of the distance between the two vertical production wells.

Although steam floods by central well injection in inverted 5-spot and inverted 9-spot well patterns have attained oil recoveries in excess of 50%, these well patterns can leave areas of high oil saturation in the lower layers of oil sands. High residual oil saturations are left in thick oil sands. The additional production of infill wells between central injectors and corner wells are effective in improving steam conformance, but still fail to reduce oil saturation in the lower layers in the areas between the corner and side wells. Horizontal wells drilled between corner wells of rectangular well patterns can improve vertical conformance of the steamflood and increase oil recovery to a large degree. The inclusion of these horizontal wells may also allow the use of larger pattern sizes. Such horizontal and vertical well combination patterns are also particularly applicable to thick reservoirs where steam override is a major drawback to steamflood operations.

The invention well pattern requires a substantially horizontal production well approximately located on and parallel to an axis running between two substantially vertical production wells. The horizontal production well should have a length of about 30% to about 60%, preferably about 30% to about 50% of the distance between the two vertical production wells and be located approximately midway between the two vertical production wells.

The placing of the horizontal production well between two vertical production wells in well patterns permits the recovery of larger amounts of oil. The increased oil recovery comes primarily from areas of high residual oil saturation between vertical production wells that would be left in the reservoir without a horizontal production well located between the two vertical production wells. These oval-shaped areas of high oil saturation normally exist over about 80% to about 90% of the distance between the vertical producers.

If given the idea of placing a horizontal production well in the area of high oil saturation that exists between two vertical producers in an inverted pattern, one of ordinary skill in the art would believe that the horizontal well should cover most of the high oil saturation area for the best recovery. However, we have unexpectedly discovered that approximately the same quantity of oil can be recovered from such patterns when the horizontal production well has a relatively short length of about 30% to about 60%, preferably about 30% to about 50% of the distance between the two vertical wells. Surprisingly, oil recovery is about the same when the horizontal well extends through only a portion of the high saturation area between the vertical wells than when the horizontal well extends throughout the high oil saturation area. And by substantially shortening the length of expensive horizontal wells to be drilled and completed, significant cost savings result. For example, changing the length of such a horizontal well from 83% to 50% of the distance between the vertical producers recovered 95% of the additional oil recovered by the 67% longer horizontal well. See Example 5.

The invention well pattern can be obtained by modifying conventionally well known inverted 5-spot, inverted 9-spot, and inverted 13-spot vertical well patterns by placing horizontal wells between corner wells of those patterns or between a corner well and a side well of those patterns. It is well known in the art that an inverted 5-spot vertical well pattern comprises a central injector and four corner production wells; an inverted 9-spot adds four side wells between the corner wells of an inverted 5-spot pattern; and an inverted 13-spot well pattern adds four infill wells between the four corner wells and the central injection well of an inverted 9-spot pattern. Other well patterns may also be modified to yield the invention well pattern, provided that there is a horizontal production well running between two vertical production wells having the specified length.

FIGS. 1–6 illstate well patterns embodying the invention. FIG. 1 shows the invention wherein a horizontal production well 13 is placed between two vertical production wells 11 and 12 in a well pattern, said horizontal production well 13 having a length of about 30% to about 60% of the distance between the two vertical production wells 11 and 12.

Figure 2:
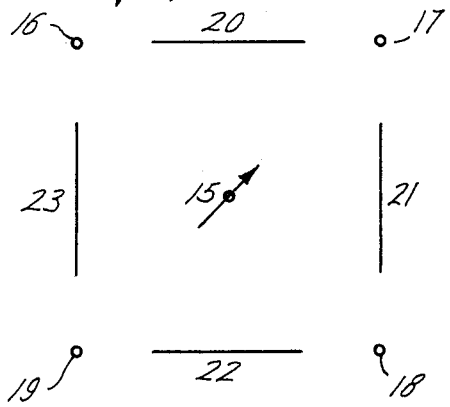
FIG. 2 illustrates an embodiment of the invention, wherein the well pattern is a modified inverted 5-spot pattern having four horizontal production wells between the four vertical corner production wells.

FIG. 2 illustrates how the invention may be applied to an inverted 5-spot well pattern having central vertical injection well 15 and vertical corner production wells 16, 17 18 and 19. Horizontal production wells 20, 21, 22 and 23 are placed between the four vertical corner production wells 16, 17, 18 and 19. The horizontal production wells have a production length of about 30% to about 60% of the distance between the vertical corner production wells.

Figure 3:
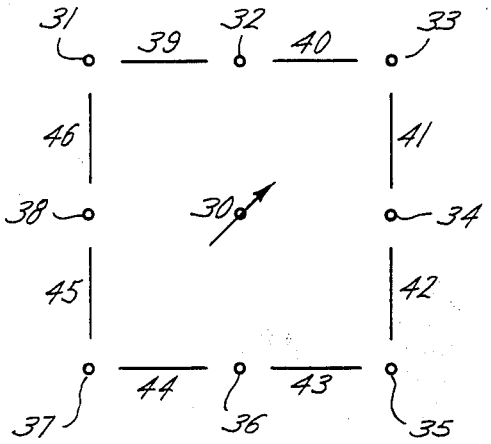
FIG. 3 illustrates an embodiment of the invention, wherein the well pattern is a modified inverted 9-spot pattern having horizontal production wells between each pair of vertical corner and side production wells.
Figure 4:
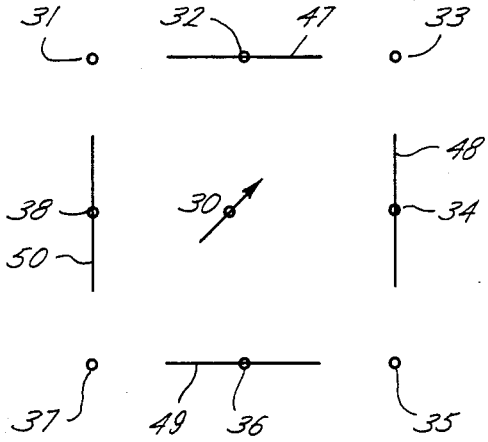
FIG. 4 is illustrates an embodiment of the invention, wherein the well pattern is a modified inverted 9-spot pattern having horizontal production wells placed between the four corner vertical production wells.

FIGS. 3 and 4 illustrate two different embodiments of the invention as it may be applied to inverted 9-spot well patterns. Well 30 is a vertical central injection well surrounded by vertical corner production wells 31, 33, 35 and 37, and by vertical side production wells 32, 34, 36 and 38. In FIG. 3, horizontal production wells 39, 40, 41, 42, 43, 44, 45 and 46 are placed between each pair of vertical corner production wells and vertical side production wells. In FIG. 4, horizontal production wells, 47, 48, 49 and 50 are placed between the vertical corner production wells 31, 33, 35 and 37. In each case, the horizontal production wells have a production length equal to about 30% to about 60% of the distance between the two vertical production wells.

Figure 5:
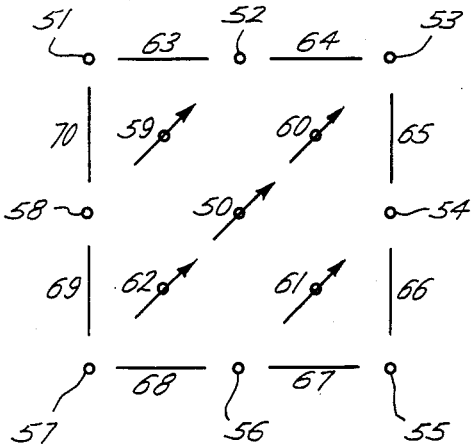
FIG. 5 illustrates an embodiment of the invention, wherein the well pattern is a modified inverted 13-spot well pattern having horizontal production wells placed between each pair of vertical side and corner priduction wells.
Figure 6:
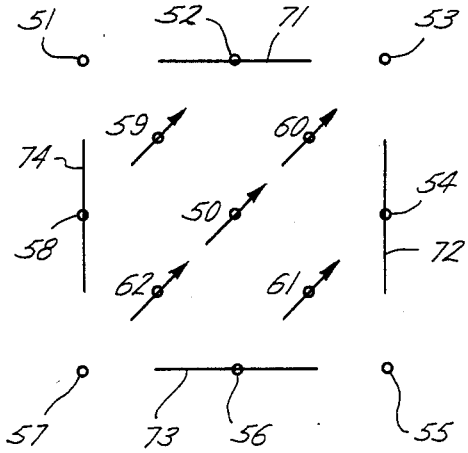
FIG. 6 illustrates an embodiment of the invention wherein the well pattern is a modified inverted 13-spot pattern having four horizontal production wells placed between the four vertical corner production wells.

FIGS. 5 and 6 illustrate the invention as it may be applied to inverted 13-spot patterns. Vertical central injection well 50 is shown surrounded by vertical corner production wells 51, 53, 55 and 57, and by vertical side production wells 52, 54, 56 and 58. Four infill wells 59, 60, 61 and 62 are illustrated between the central injection well 50 and the four corner production wells 51, 53, 55 and 57. In FIG. 5, horizontal production wells 63, 64, 65, 66, 67, 68, 69 and 70 are located production each pair of vertical corner and vertical side production wells. In FIG. 6, horizontal production wells 71, 72, 73 and 74 are placed between the four vertical corner production wells 51, 53, 55 and 57.

Although the infill wells 59, 60, 61 and 62 are illustrated in FIGS. 5 and 6 as injection wells, it should be noted that these wells may also be production wells depending upon the recovery method employed with the well pattern. As described in Example 2 and Examples 3–5, infill wells 59, 60, 61 and 62 may be both injection and production wells. Infill wells usually are production wells at the beginning of pattern life and are usually converted later to injection wells, as shown in FIGS. 5 and 6.

The diameter of the horizontal wells and the perforation intervals are not critical, except that such factors will affect the well spacing and the economics of the process. Such decisions should be determined by conventional drilling criteria, the characteristics of the specific formation, the economics of a given situation, and well known art of drilling horizontal wells. Perforation size will be a function of other factors such as flow rate, temperatures and pressures employed in a given operation. Preferably, the horizontal wells will be extended into the formation at a position near the bottom of the formation.

Such horizontal wells must run a substantially horizontal distance within the hydrocarbon formation. To communicate with the surface, horizontal wells may extend from the surface or may extend from a substantially vertical well within the formation, which communicates with the surface. Newly developed horizontal well technology has now made it possible to drill substantially horizontal wells from an existing vertical wellbore. The horizontal wells may even run parallel to and within a pay zone having a certain degree of dip. Such wells are still considered horizontal wells for the purposes of this invention.

The following examples will illustrate the invention. They are given by way of illustration and not as limitations on the scope of the invention. Thus, it should be understood that a process can be varied from the description and the examples and still remain within the scope of the invention.

EXAMPLES

A commercially available 3-dimensional numerical simulator developed for thermal recovery operations was employed for the examples. The model used was "Combustion and Steamflood Model-THERM" by Scientific Software-Intercomp. The model accounts for three phase flow described by Darcy's flow equation and includes gravity, viscous and capillary forces. Heat transfer is modeled by conduction and convection. Relative permeability curves are temperature dependent. The model is capable of simulating well completions in any direction (vertical, horizontal, inclined or branched).

Reservoir properties used in the study are typical of a California heavy oil reservoir with unconsolidated sand. A dead oil with an API gravity of 13 degrees was used in the simulation. The assumed reservoir properties are listed in Table 1.

EXAMPLE 1

An 18.5 acre (7.5 ha) inverted 9-spot pattern was used as a basis for this simulation study. Inverted 9-spot patterns are square-shaped and contain four corner producers, four side producers between the corner wells and one central injection well at the middle of the pattern. The 125-foot (38-m) thick formation was divided into five equal layers. All wells were completed in the lower 60% of the oil sand. Steam at 65% quality was injected into the central well at a constant rate of 2400 BPD (381 $m^3/d$) cold water equivalent. The project was terminated when the fuel required to generate steam was equivalent to the oil produced from the pattern or instantaneous steam-oil ratio (SOR) of 15. A maximum lifting capacity of 1000 BPD (159 $m^3$/d) was assumed for each producing well.

The resulting oil recovery at the end of the project life (15 years) was 64.7% of the original oil in place. The predicted oil saturation profile indicated a good steam sweep throughout the upper three layers to an oil saturation less than 0.2 (the upper 60% of the oil zone), but steam bypassed most of the lower two layers except near the injection well. Oval-shaped regions of high oil saturation aligned along the pattern boundaries were also left between the corner and side wells.

EXAMPLE 2

Four infill wells were added to the simulation grid midway between the center and corner wells to form an inverted 13-spot well pattern. The wells were completed in the lower one-third of the zone only and infill production began after three years of steam injection and continued to the end of the project.

Ultimate recovery was only 63.2% of the original oil in place after 11 years, but the oil was recovered sooner. For the inverted 9-spot pattern of Ex. 1, the oil recovery at 11 years would have been only 57% at this time. Because of the presence of infill wells, oil production which would otherwise arrive at corner and side wells was reduced. As a result, the inverted 13-spot pattern would reach its economic limit much sooner than an inverted 9-spot pattern unless other operational changes are made.

The oil recovery profile for Example 2 was about the same as for Ex. 1, but was reached four years sooner than in Ex. 1. There were still high oil saturation regions between the corner and side wells.

EXAMPLES 3–5

Eight horizontal wells were added to the 13-spot pattern of Example 2 such that the horizontal wells were located along the sides of the rectangular well pattern between each pair of side and corner wells. The general procedure of Example 2 was followed. Infill well production was begun after three years. After six years of injection through the central injector which corresponded to the injection of almost one pore volume of steam, the infill wells were converted to injection wells at a steam injection rate of 300 bbl/day (cold water equivalent) through each infill well. When the infill wells were converted to steam injectors, the central well was converted to hot water injection at the rate of 4800 bbl/day. Horizontal well production was also started at this time, six years after initiation of injection through the central injection well.

Example 3 achieved a recovery of 67% of original oil in place after ten years and 71.1% of original in place after 15 years. Example 3 also gave the best steam/oil ratio with a cumulative steam/oil ratio at the end of 15 years of 3.2 compared with 5.0 for the base case of Example 1. By contrast, Example 1 done on an inverted 9-spot pattern without infill wells or horizontal wells yielded 64.7% of the original oil in place after 15 years, and the steam by-passed most of the lower 40% of the oil zone. Example 2 performed with an inverted 13-spot pattern containing infill wells gave an ultimate recovery of 63.2% of the original oil in place after 11 years and left high oil saturation regions between the corner wells.

Example 4 was a repeat of Example 3, except that the pattern size was increased to 25 acres from 18.5 acres. The length of the horizontal wells between the corner and side wells was 435 feet, or 83% of the 522 foot distance between the corner and side wells of the pattern. Oil recovery decreased from 71.1% to 69.0% of the original oil in place.

Example 5 was a repeat of Example 4 on the 25 acre pattern except that the length of the horizontal wells placed between the corner and side wells was reduced to 261 feet from the 435 foot length of Example 4. The 261 foot wells occupied 50% of the distance between the corner and side wells and were placed approximately midway between the corner and side wells. Oil recovery through the horizontal production wells was 95% of the quantity of cumulative oil produced by the longer horizontal wells of Example 4.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

TABLE 1

RESERVOIR AND FLUID PROPERTIES - SIMULATION OF EXAMPLES 1–5

| | | |
|---|---|---|
| Porosity, fraction | | 0.39 |
| Initial Fluid Saturations, Fraction: | | |
| Oil | | 0.589 |
| Water | | 0.411 |
| Gas | | 0 |
| Initial Reservoir Temperature, °F.(°C.) | | 100 (37.7) |
| Initial Reservoir Pressure, psi (kPa) | | 50 (345) |
| Permeability, md: | | |
| Horizontal ($\mu m^2$) | | 3000 (3) |
| Vertical | | 900 (0.9) |
| Reservoir Thermal Conductivity, Btu/day-ft-°F. (W/m-°C.) | | 31.2 (2.25) |
| Reservoir Heat Capacity, Btu/$ft^3$-°F. (kJ/$m^3$-°C.) | | 37.0 (2481) |
| Cap and Base Rock Thermal Conductivity, Btu/day-ft-°F. (kJ/$m^3$-°C.) | | 24.0 (1.73) |
| Cap and Base Rock Heat Capacity, Bt /$ft^3$-°F. (kJ/$m^3$-°C.) | | 46.0 (3085) |
| Oil Viscosity, | cp @ °F. | Pa.s @ °C. |
| | 1230 @ 100 | 1.23 @ 37.7 |
| | 10 @ 300 | 0.01 @ 148.9 |
| | 3.99 @ 400 | 0.00399 @ 204.4 |
| Quality of Injected Steam, fraction (at sand face) | | 0.65 |
| Residual Oil Saturation, Fraction | | |
| to water: | | 0.25 |
| to steam: | | 0.15 |

What is claimed is:

1. A well pattern having at least one substantially horizontal production well, and at least two substantially vertical production wells, which comprises:

a substantially horizontal production well approximately located on and parallel to an axis running between two substantially vertical production wells, said horizontal production well having a length of about 30% to about 60% of the distance between the two vertical production wells.

2. The well pattern of claim 1, wherein the horizontal production well is approximately centered between the two vertical production wells.

3. The well pattern of claim 1, wherein the two vertical production wells are corner wells of an inverted 5-spot vertical well pattern.

4. The well pattern of claim 1, wherein one of the two vertical production wells is a corner well and the second vertical production well is a side well of an inverted 9-spot vertical well pattern.

5. The well pattern of claim 1, wherein one of the two vertical production wells is a corner well and the second vertical production well is a side well of an inverted 13-spot vertical well pattern.

6. The well pattern of claim 1, wherein the two vertical production wells are corner wells of an inverted 9-spot vertical well pattern.

7. The well pattern of claim 1, wherein the two vertical production wells are corner wells of an inverted 13-spot vertical well pattern.

8. The well pattern of claim 1, wherein the horizontal production well has a length of about 30% to about 50% of the distance between the two vertical production wells.

9. A modified inverted 5-spot vertical well pattern having at least one substantially horizontial production well, one substantially vertical central injection well, and four substantially vertical corner production wells, which comprises:

at least one substantially horizontial production well approximately centered between two of the vertical corner production wells and approximately located on and parallel to an axis running between the two substantially vertical corner production wells, said horizontal production well having a length of about 30% to about 50% of the distance between the two vertical corner production wells.

10. A modified inverted 9-spot vertical well pattern having at least one substantially horizontal production well, one substantially vertical central injection well, and a number of substantially vertical production wells, which comprises:

a substantially horizontal production well approximately centered between two of the vertical production wells and approximately located on and parallel to an axis running between the two substantially vertical production wells, said horizontal production well having a length of about 30% to about 50% of the distance between the two vertical production wells.

* * * * *